United States Patent [19]

Brinkman

[11] 3,943,892

[45] Mar. 16, 1976

[54] INJECTOR

[75] Inventor: Willem Brinkman, Velp, Netherlands

[73] Assignee: Holec N.V., Hengelo, Netherlands

[22] Filed: Mar. 19, 1974

[21] Appl. No.: 452,619

[30] Foreign Application Priority Data

Nov. 16, 1973 Netherlands ..... 7315770

[52] U.S. Cl. 123/32 EA; 123/139 AC; 123/139 DE; 123/139 E; 417/415

[51] Int. Cl.[2] ..... F02B 3/00

[58] Field of Search ..... 123/32 EA, 97 B, 139 AC, 123/139 E, 139 DE, 139 AD, 139 AW, 140 MP; 417/410, 415

[56] References Cited

UNITED STATES PATENTS

| | | | |
|---|---|---|---|
| 1,662,040 | 3/1928 | Lee | 123/139.2 |
| 1,897,044 | 2/1933 | Elwell | 123/139 AC |
| 1,956,923 | 5/1934 | Jendrassik | 123/139 AC |
| 2,852,011 | 9/1958 | Pringham | 123/139 DE |
| 2,893,366 | 7/1959 | Nystrom | 123/139 DE |
| 3,463,130 | 8/1969 | Reichardt | 123/32 EA |
| 3,612,013 | 10/1971 | Gambill | 123/32 EA |
| 3,794,003 | 2/1974 | Reddy | 123/32 EA |
| 3,797,235 | 3/1974 | Eheim | 123/139 E |
| 3,809,028 | 5/1974 | Luchaco | 123/32 EA |
| 3,822,678 | 7/1974 | Bassot | 123/32 EA |

*Primary Examiner*—Charles J. Myhre
*Assistant Examiner*—Daniel J. O'Connor
*Attorney, Agent, or Firm*—Snyder, Brown and Ramik

[57] ABSTRACT

An injector for delivering fuel to at least one atomizer of a combustion engine comprises at least one pump communicating with the atomizer and control-means depending upon the pressure in the inlet manifold of the combustion engine for regulating the quantity of fuel to be atomized by the atomizer.

The invention has for its object to avoid, in the decelerating state of the combustion engine, environmentally polluting constituents in the exhaust gases of the combustion engine and to prevent spoiling of fuel.

This is achieved by providing the control-means with a switch for stopping the pump when the pressure in the inlet manifold drops below a given value. Soon after the decelerating state of the combustion engine is realized, this injector does no longer supply any fuel.

17 Claims, 5 Drawing Figures

INJECTOR

Figure 1:
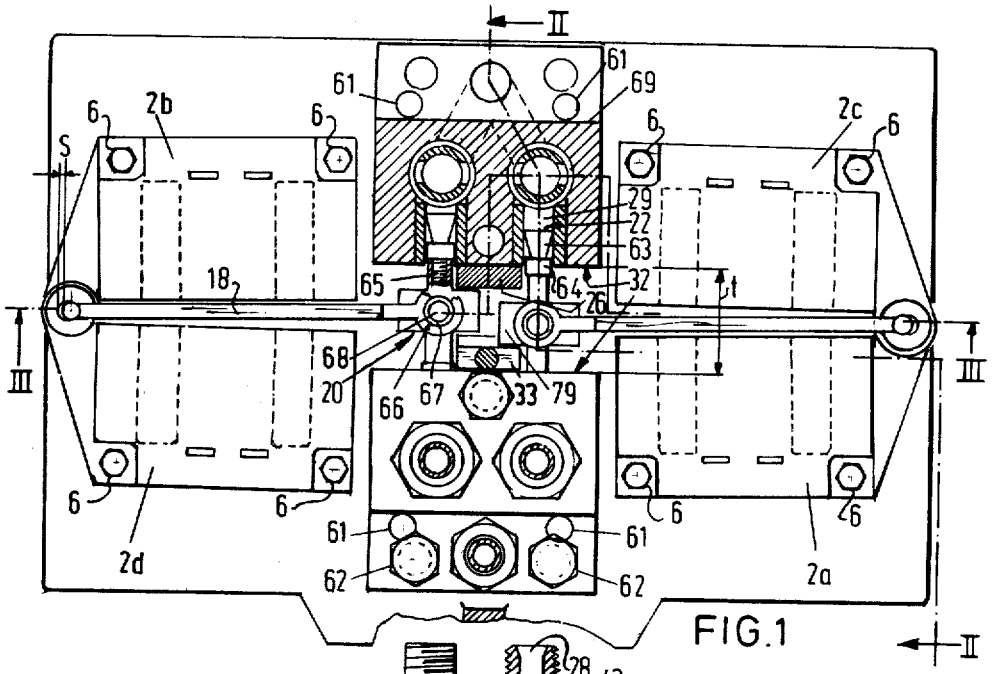

The invention relates to an injector for delivering fuel to at least one atomizer of a combustion engine comprising at least one pump communicating with the atomizer and control-means depending upon the pressure in the inlet manifold of the combustion engine for regulating the quantity of fuel to be atomized by the atomizer.

Such an injector is known. The control-means regulate the quantity of fuel in dependence upon the power to be supplied by the combustion engine. When the combustion engine is decelerated, the quantity of fuel pumped towards the atomizer is small because a fuel valve is then closed. Until the instant of complete closure of said valve there is a period in which still a small supply of fuel is fed to the atomizer. A small quantity of fuel cannot be satisfactorily atomized so that when the prior art injector is employed the combustion of the imperfectly atomized fuel is incomplete and a considerable content of, for example, CH-compounds and/or CO polluting the environments is found in the exhaust gases of the combustion engine.

The invention has for its object to avoid, in the decelerating state of the combustion engine, environmentally polluting constituents in the exhaust gases of the combustion engine and to prevent spoiling of fuel.

This is achieved by providing the control-means with a switch for stopping the pump when the pressure in the inlet manifold drops below a given value. Soon after the decelerating state of the combustion engine is realized, this injector does no longer supply any fuel. In this way inadequate combustion in the decelerating state of the combustion engine is avoided with certainty.

In order to cause the switch to respond immediately to a drop of pressure in the inlet manifold below a predetermined minimum value the switch is preferably actuated by means of a barrel-shaped piston in a cylinder to be connected with the air inlet manifold of a combustion engine. This piston is preferably subjected via a central ball to the force of a resetting spring.

With this injector frictional resistance between the piston and the cylinder due to scraping of the piston is avoided.

The invention provides furthermore a combustion engine comprising an injector embodying the invention.

The aforesaid and further features of the invention will be described more fully hereinafter with reference to a drawing.

Figure 3:
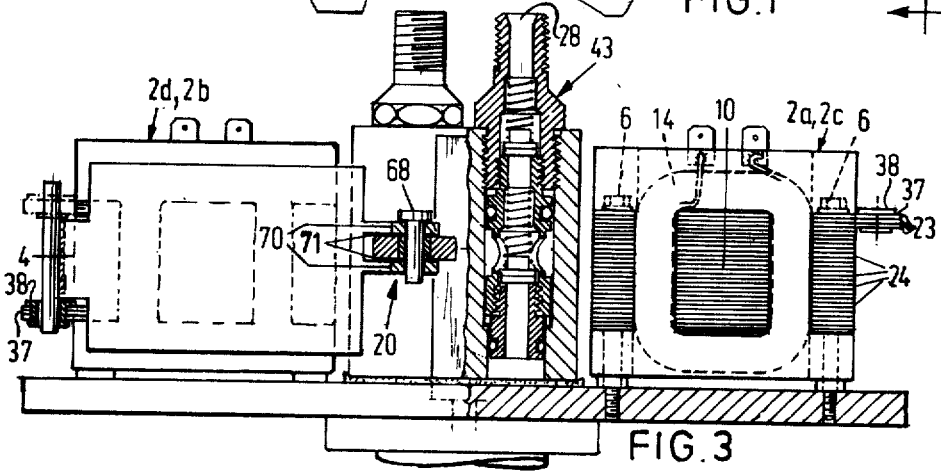
Figure 2:
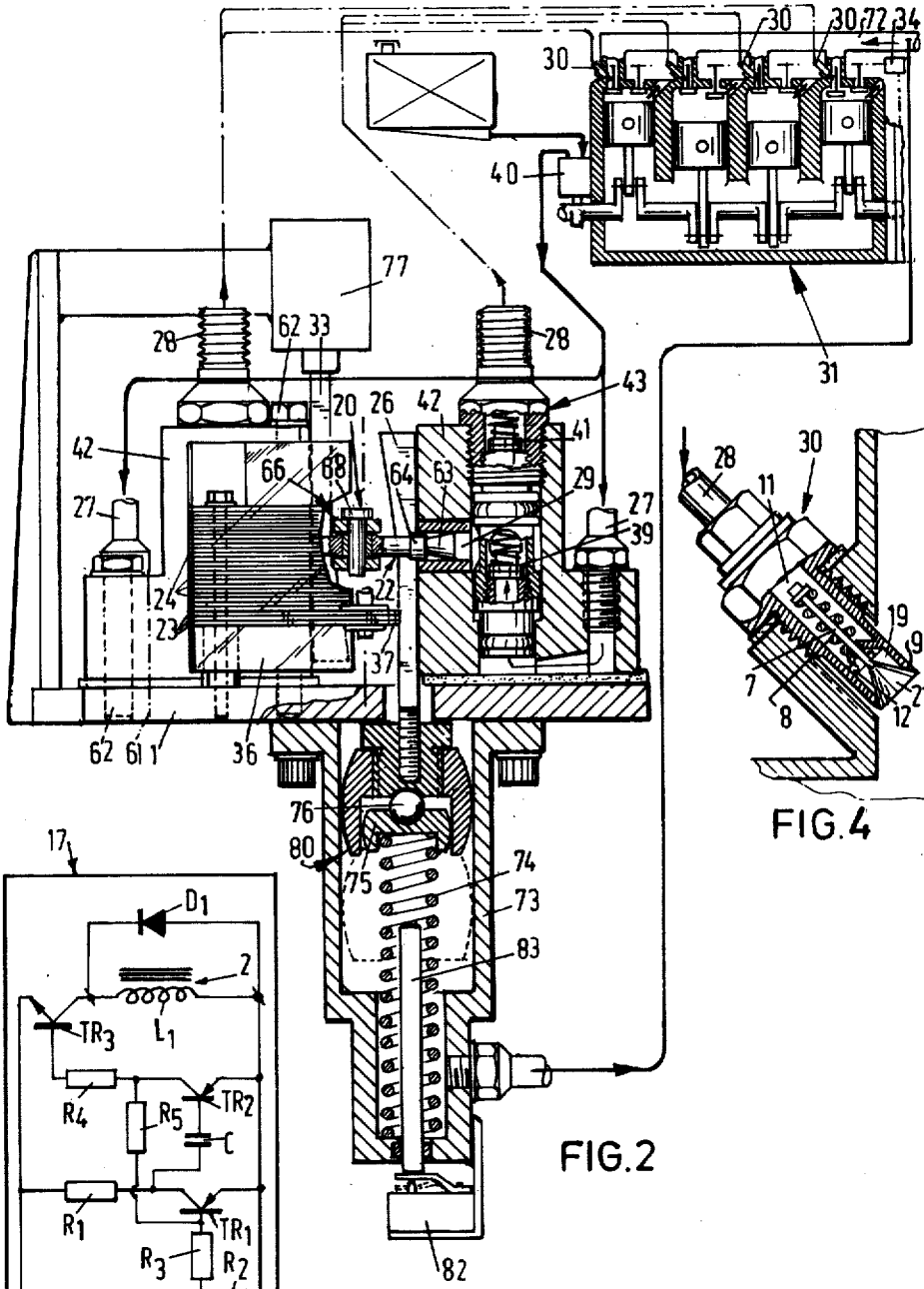
Figure 4:
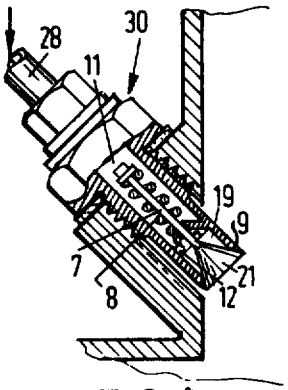
Figure 5:
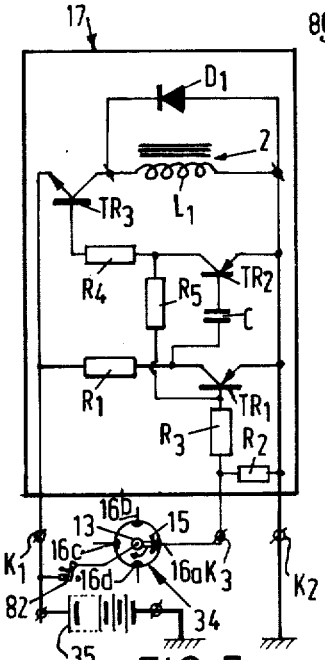

In the drawing:

FIG. 1 is a plan view, partly broken away, of a preferred embodiment of an injector in accordance with the invention, FIG. 2 is a sectional view taken on the line II—II in FIG. 1 with a schematically shown connection with a combustion engine, FIG. 3 is a sectional view taken on the line III—III in FIG. 1, FIG. 4 shows, on an enlarged scale, an atomizer and FIG. 5 is a circuit diagram of an electronic circuitry.

Two pairs of electro-magnets 2 are fastened by means of bolts 6 to a mounting plate 1. Each of the electro-magnets 2 comprises a core 10 formed by a stack of magnet plates 23 and 24 and an energizing coil 14 surrounding said core 10. Between each pair of alternately energized magnets 2 is pivotally arranged a sheet-like armature 18. Each armature 18 is pivotally connected at one end 4 with projecting ears 37 of the magnet plates 23 of each of the pair of electro-magnets 2 by means of an elastic coupling formed by a ring 38 of elastic material, for example, a superpolyamide. Since the ring 38 is lodged in a recess with a clearance S of, for example, 0.2 mm, the armature 38 is slightly displaceable in its direction of length. At the free end 5 each armature 18 is provided with a cross-like coupling member 20, with which are connected two displacer bodies 22 of two fuel pumps 32. The stroke of the displacer bodies is determined by adjustable control-means arranged on either side of the coupling members 20 and formed by two wedges 26 and 33. Each pump 32 comprises a pump chamber 29 communicating via an inlet valve 39 with a fuel inlet 27 and via an outlet valve 41 with a fuel delivery duct 28 leading to an atomizer 30 of a combustion engine 31.

Into each pump housing 42 is pressed a hard-steel cylinder 59 with heavy compression fit. Afterwards the front face 60 of the cylinder 59 and of the pump housing 42 is ground to flatness. The pump housings 42 are disposed pairwise coaxially opposite one another and are held at a distance *t* from one another by means of connecting means. These connecting means are formed by fitting pins 61 and bolts 62 securing the pump housings 42 rigidly to the mounting plate 1. By means of the fitting pins 61 the front faces 60 are held in accurate parallel relationship.

The displacement volume of each fuel pump 32 is determined by the stroke of the coupling member 20, which is adapted to reciprocate by means of an arm 79 between the wedges 26 and 33.

Two blocks of housings 69 comprise each two joined pump housings 42, between which wedges 26 and 33 are arranged, which serve as common control-means for each of the pumps 32. The distance *t* and the coupling members 20 are small so that inaccuracies in pump outputs due to deformation of coupling members and/or due to mounting tolerances are slight.

A fourth arm 70 is provided with guide surfaces 71, which co-operate with the armature 18 in order to avoid tilting of the coupling member 20.

Each atomizer 30 comprises a needle 7, a conical end 21 of which is sealingly drawn to the seat 9 by a strong spring 8. Said end 21 is urged away from the seat 9 against the action of the spring 8 at a high pressure of fuel in a chamber 11 communicating with the fuel duct 28 and through a chamber 19 communicating herewith through a perforated collar 12 (see FIG. 4).

Each electro-magnet 2 is controlled by a circuitry 17 shown schematically in FIG. 5. The transistors $TR_1$ and $TR_2$ together with the associated resistors $R_1$, $R_2$, $R_3$, $R_4$ and $R_5$ and the capacitor C constitute a monostable multivibrator. The resistor $R_1$ and the capacitor C determine the time constant. The collector output of the transistor $TR_2$ constitutes through the resistor $R_4$ the input of the transistor $TR_3$, which serves as an amplifier for the current to be passed through the coil $L_1$ of the electro-magnet 2. Across the coil $L_1$ is connected a quenching diode $D_1$. To the imput terminals $K_1$ and $K_2$ is connected a supply source 35, whereas the input $K_3$ serves for the supply of a control-pulse which may originate from a pulse generator 34 coupled with the engine 31. The pulse generator 34 may be coupled with a cam shaft 13 of the combustion engine 31 and comprises a rotatable contact 15, which alternately engages one of the four contacts 16*a*, 16*b*, 16*c* and 16*d* for energizing sequentially the electro-magnets 2*a*, 2*b*, 2*c* and 2*d*. Each of said four contacts 16*a*, 16*b*, 16*c* and 16*d* is connected to an input terminal $K_3$ of the circuitry 17. In this way an atomizer 30 injects the fuel required for each combustion cylinder at the required instant in each cycle of the combustion engine 31. The order of succession of energization of the electro-magnets 2*a* and 2*d* is chosen so that in each cycle each of the wedges 26 and 33 is momentarily released from a coupling member 20 so that they can be displaced each with a slight force.

FIG. 3 illustrates the drive of the wedge 26 by means of a barrel-shaped piston 80 of a cylinder 73 communicating with the air inlet manifold 72 of the combustion engine 31.

A reset spring 74 engages centrally the piston 80 via a cup spring 75 and a ball 76. Frictional resistance due to scraping of the piston 80 is thus prevented from delaying the adjustment of the wedge 26. The cylinder 73 has secured to it an electric switch 82, which is actuated by means of a rod 83 by the cup-spring 75 of the piston 80, when the pressure in the inlet manifold 72 drops below a given value, which may be about 200 mms Hg absolute value. The tension of the spring 74 and the switching position of the piston 80 indicated by dotted lines in FIG. 3 are chosen accordingly. Said given value lies between the pressures of about 250 and 150 mms Hg, produced in the inlet manifold 72 in the no-load state (stationary run) and with deceleration respectively. At the switching position of the piston 80 the wedge 26 is in the minimum position, in which the pumps 32 deliver the minimum quantity of fuel required for a perfect atomization. The switch 82 is arranged between the accumulator 35 and the contact 15 so that when the switch 82 is put off, no control-pulses are emitted. The other wedge 33 is adjusted by a control-member 77 independently of the wedge 26, under the action of other factors such as atmospheric pressure or engine temperature. The wedge 33 and the control-member 77 may be omitted. In this case the distance *t* is smaller.

What is claimed is:

1. In combination with an internal combustion engine provided with a fuel atomizer having a pressure-responsive outlet valve;

electrically actuated pump means for discharging fuel at intermittent intervals and at increasing volumetric rate during each such interval;

control means for varying the quantity of fuel discharged by said pump means during said intervals in accord with operating conditions of the engine;

conduit means connecting said pump means to said atomizer for directing fuel discharged by said pump means to said atomizer, said conduit means having finite volumetric capacity whereby at some minimum value of the quantity of fuel discharged by said pump means as controlled by said control means said atomizer can no longer adequately atomize the discharged fuel; and switch means actuated in consonance with said control means for deenergizing said pump means when said pump means would otherwise discharge said minimum value quantity of fuel.

2. In the combination defined in claim 1 wherein said control means includes an adjustable stop and a vacuum-controlled member connected to said stop, said engine having an air intake manifold and said vacuum-controlled member is connected to said manifold for actuation in response to pressure fluctuations therein.

3. In the combination defined in claim 2 wherein said switch means is actuated by said vacuum-controlled member.

4. In the combination defined in claim 3 wherein said vacuum-controlled member is in the form of a piston/-cylinder assembly, the piston of which is barrel-shaped.

5. In the combination defined in claim 4 wherein said stop is in the form of a wedge.

6. In the combination defined in claim 2 wherein said vacuum-controlled member is in the form of a piston/-cylinder assembly, the piston of which is barrel-shaped.

7. In the combination defined in claim 6 wherein said stop is in the form of a wedge.

8. In the combination defined in claim 1 wherein said pump means includes a variable volume fluid chamber and a movable member for varying the volume of said chamber, an armature connected to said movable member, and a pair of electromagnets disposed on opposite sides of said armature, and means for alternately energizing said electromagnets.

9. In the combination defined in claim 8 wherein said control means includes an adjustable stop and a vacuum-controlled member connected to said stop, said engine having an air intake manifold and said vacuum-controlled member is connected to said manifold for actuation in response to pressure fluctuations therein.

10. In the combination defined in claim 9 wherein said switch means is actuated by said vacuum-controlled member.

11. In the combination defined in claim 10 wherein said vacuum-controlled member is in the form of a piston/cylinder assembly, the piston of which is barrel-shaped.

12. In the combination defined in claim 11 wherein said stop is in the form of a wedge.

13. In the combination defined in claim 9 wherein said vacuum-controlled member is in the form of a piston/cylinder assembly, the piston of which is barrel-shaped.

14. In the combination defined in claim 13 wherein said stop is in the form of a wedge.

15. In the combination defined in claim 8 wherein said control means comprises a pair of stops disposed on opposite sides of said armature, one of said stops being in the form of a wedge and being axially movable, said engine having an air intake manifold and said control means being in the form of a piston/cylinder assembly connected to said intake manifold for actuation thereby and said piston being connected to said wedge axially to move same.

16. In the combination as defined in claim 15 wherein said switch means is actuated by said piston.

17. In the combination defined in claim 16 wherein said piston is barrel-shaped.

* * * * *

UNITED STATES PATENT AND TRADEMARK OFFICE

CERTIFICATE OF CORRECTION

PATENT NO. : 3,943,892

DATED : March 16, 1976

INVENTOR(S) : Willem Brinkman

It is certified that error appears in the above-identified patent and that said Letters Patent are hereby corrected as shown below:

Column 3, line 8, change "and" to ---to---.

Signed and Sealed this

*eighth* Day of *June 1976*

[SEAL]

*Attest:*

RUTH C. MASON
*Attesting Officer*

C. MARSHALL DANN
*Commissioner of Patents and Trademarks*